United States Patent [19]

Lee et al.

[11] 4,397,234

[45] Aug. 9, 1983

[54] ELECTROMAGNETIC PRINT HAMMER COIL ASSEMBLY

[75] Inventors: Ho C. Lee, Endicott; David H. Rickenbach, Chenango Forks, both of N.Y.; Gerhard A. Wolfert, Stuttgart, Fed. Rep. of Germany; Jack L. Zable, Vestal, N.Y.

[73] Assignee: International Business Machines Corporation, Armonk, N.Y.

[21] Appl. No.: 335,898

[22] Filed: Dec. 30, 1981

[51] Int. Cl.[3] ..... B41J 9/38

[52] U.S. Cl. ..... 101/93.29; 101/93.48; 336/61; 335/300; 361/388

[58] Field of Search ..... 101/93.04, 93.05, 93.29, 101/93.34, 93.48; 336/61, 62; 335/300; 361/379, 386, 387, 388

[56] References Cited

U.S. PATENT DOCUMENTS

| | | | |
|---|---|---|---|
| 3,187,226 | 6/1965 | Kates | 361/388 X |
| 3,196,783 | 7/1965 | Gross | 101/109 |
| 3,351,698 | 11/1967 | Marinace | 361/388 X |
| 3,434,413 | 3/1969 | Lee et al. | 101/93.34 |
| 3,590,327 | 6/1971 | Thomae | 361/386 X |
| 3,764,856 | 10/1973 | Martin | 361/387 X |
| 4,009,459 | 2/1977 | Benson et al. | 335/300 |
| 4,033,255 | 7/1977 | Kleist et al. | 101/93.04 |
| 4,044,668 | 8/1977 | Barrus et al. | 101/93.48 X |
| 4,081,776 | 3/1978 | Hisamoto et al. | 336/61 |
| 4,269,117 | 5/1981 | Lee et al. | 101/93.48 X |

*Primary Examiner*—Edward M. Coven
*Attorney, Agent, or Firm*—John S. Gasper

[57] ABSTRACT

A heat exchange system for an electromagnetically operated print hammer of a print hammer bank provides internal and external heat transfer for the operating windings. A non-magnetic metal bobbin of the heat exchange system provides conductive transfer of heat from the interior of the operating winding to the magnetic core. Flat parallel plates of magnetic material are attached to the sides of the operating winding for external heat transfer and magnetic flux shielding. The plates may have multiple laminations having different saturation and permeability characteristics.

17 Claims, 7 Drawing Figures

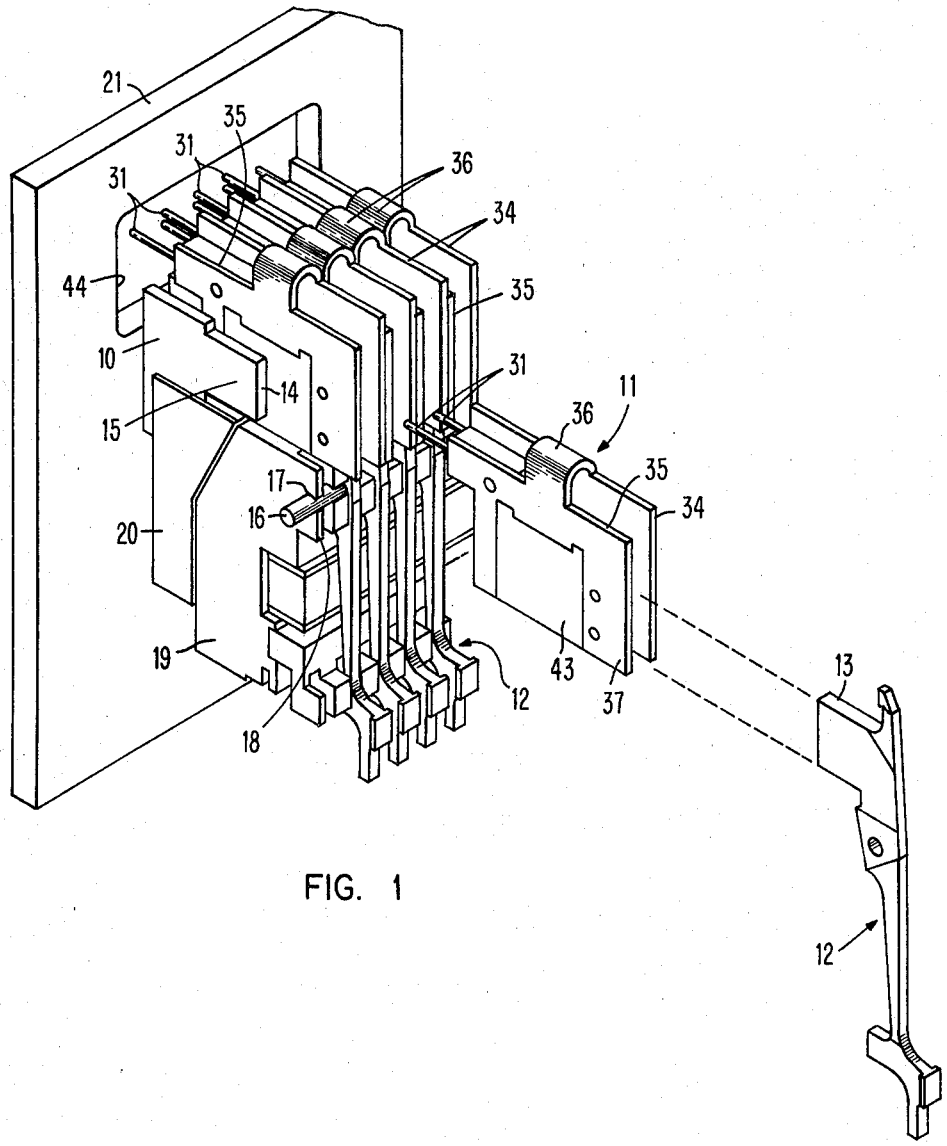
FIG. 1
FIG. 6
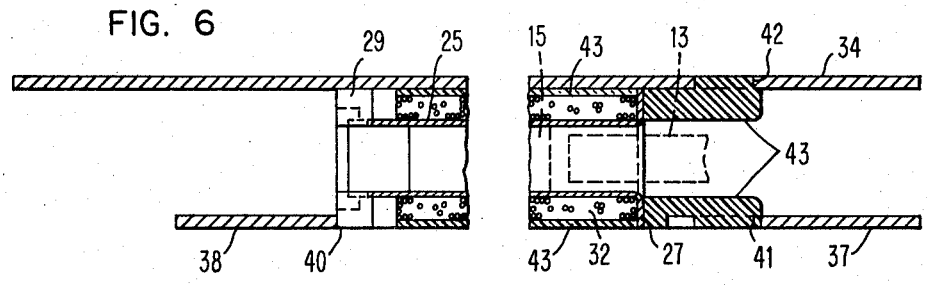

ELECTROMAGNETIC PRINT HAMMER COIL ASSEMBLY

TECHNICAL FIELD

This invention relates to electromagnetic print hammers and particularly to print hammers utilized in print hammer banks for high speed line printers.

BACKGROUND OF THE INVENTION

High speed line printers use a multiplicity of print hammers actuated by electromagnets assembled in banks. The hammers are of necessity closely spaced. The requirement for compactness of the designs raises problems of overheating and magnetic interaction both of which can adversely affect the reliability of operation of the print hammers and the quality of the resultant printing. Current solutions for cooling the coils of the electromagnets and for eliminating magnetic interaction are thermally inefficient, complex to manufacture and require too much space thereby reducing the compactness and/or operating efficiency of the hammer units.

BACKGROUND ART

U.S. Pat. No. 4,033,255 issued July 5, 1977 to R. A. Kleist et al, describes a print hammer bank for a dot matrix printer which uses heat exchange elements of aluminum or the like attached via a concave hemispherical base to the periphery of the operating coils which is wound on an insulating bobbin on a magnetic pole. The periphery of the coil is comprised of a layer of heat conductive plastic which forms a hemispherical heat conductive coupling between the coil and the externally attached heat exchange elements which are fabricated with a special fin structure. An adhesive is used between the coil and its bobbin to prevent twisting caused by the added mass of the heat exchange elements. The coils are relatively widely spaced and share a common magnetic circuit with a permanent magnet. No provision is made to prevent magnetic interaction.

U.S. Pat. No. 3,196,783 issued July 27, 1965 to J. Gross, describes a print hammer for a high speed printer having an improved magnetic core which will prevent magnetic interaction when multiple print hammers are assembled in close proximity. The core, which is E-shaped, has an operating coil wound on the central leg within grooves formed between the central leg and the outer legs. The outer legs have extensions formed of the core material having a reduced cross-section and extending beyond the termination of the central leg to form a recess for the armature portion of the hammer element. The extensions operate to prevent stray fields. Besides being costly to fabricate, the structure would not be suitable for high density armature assemblies. While some shielding is provided, the structure has low cooling efficiency which would be detrimental for very high speed print hammer operation.

SUMMARY OF THE INVENTION

It is the object of this invention to provide an electromagnetically operated print hammer in which cooling efficiency and the elimination of magnetic interaction are greatly improved.

Basically, the invention achieves this as well as other objects by providing an operating winding which has a heat exchange system which also includes magnetic shielding. The heat exchange system provides heat conductive elements for transferring heat from the interior of the operating winding as well as from the exterior of the operating winding. The exterior heat exchange includes means for providing magnetic shielding to prevent stray flux from interacting with the operating winding. In the preferred embodiment, the internal heat exchange is provided by a non-magnetic metal bobbin on which a multi-turn, multi-layer winding is wound in a heat transfer relationship. The external heat exchange elements are preferably flat, parallel plates of magnetic material. An encapsulating mass bonds the bobbin and coil assembly between the magnetic plates in a heat transfer relationship. The magnetic plates can be formed of multiple laminations having different saturation and permeability characteristics. The external magnetic plates extend beyond and above the coil and bobbin assembly so that radiating fins project into a surrounding air mass for indirect cooling of the exterior surface of the coil. A particular feature of the operating winding assembly is to have one plate on one side which is a solid plate while the plate on the other side is U-shaped. The bobbin assembly is maintained and bonded in place by the encapsulating mass which fills the opening in the U-shaped magnetic plate. In a multiple hammer print bank the magnetic plate of the adjacent print hammer coil assembly is located proximate the U-shaped magnetic plate of the neighboring coil assembly. The individual coil assemblies are mounted with the bobbin supported on the pole of a magnetic core. The magnetic core of all the hammers are in turn mounted on a metal block or frame which acts as a heatsink. Cooling air driven by a fan or the like is caused to flow over the magnetic plates and the magnetic core thereby more efficiently cooling the operating winding.

The foregoing and other objects, features and advantages of the invention will be apparent from the following more particular description of the preferred embodiments of the invention as illustrated in the accompanying drawings.

DESCRIPTION OF THE DRAWINGS

FIG. 1 is a three-dimensional view of a multiple print hammer unit which incorporates the invention.

FIG. 6 is a section of the coil unit assembly of FIG. 5 taken along line 6—6.

DETAILED DESCRIPTION

Figure 5:
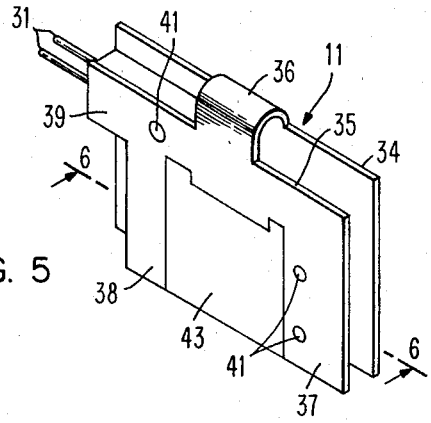
FIGS. 2–5 are a sequence of three-dimensional views showing the various elements and their assembly to form the coil subassembly for one of the print hammers of the unit of FIG. 1.

Referring to FIG. 1, a multiple hammer assembly incorporating this invention comprises a U-shaped magnetic core 10 at each of a plurality of uniformly spaced print positions with an operating winding assembly 11 and a single piece hammer element 12 cooperable with each magnetic core 10 and operating winding assembly 11. Hammer element 12 is preferably the type described in U.S. Pat. No. 4,269,117 issued May 26, 1981 to Ho C. Lee, David H. Rickenbach and Jack L. Zable. As described in that patent, hammer element 12 has an armature projection 13 which forms an operating air gap with the pole face end 14 of core leg 15 of magnetic core 10. The air gap thus formed is totally enclosed within the coil portion of the operating winding assembly 11. Hammer elements 12 are each pivotally mounted by pin 16 in groove 17 of fingers 18 formed in a hammer block 19. The cover plate, not shown, is attached to hammer block 19 for maintaining operating winding assemblies 11 and pivot pin 16 in place. Further details of the hammer element structure and pivot assembly may be seen by reference to the aforesaid U.S. patent of Lee et al.

In accordance with the preferred embodiment of this invention, the U-shaped magnetic cores 10 are held in a core block 20 of molded plastic or other non-magnetic material. Hammer block 19 in turn is attached to core block 20. This assembly is then attached by suitable means such as screws to a base plate 21. Cores 10 are molded in block 20 with the upper leg 15 of each core member projecting therefrom a sufficient amount to receive and support the operating winding assemblies 11. Base plate 21 is preferably made of metal and is in direct thermal contact with the edges of magnetic cores 10. In this manner, base plate 21 is designed to function as a heatsink for conducting heat from all the cores 10 resulting from the energization of the cores by the operating windings of operating assemblies 11.

Figure 4:
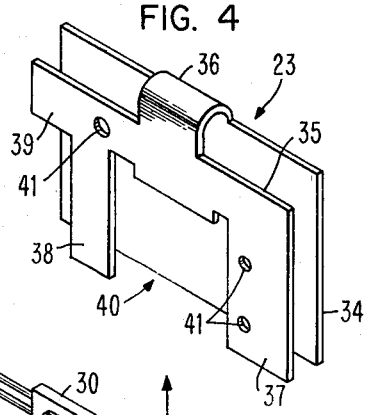
Figure 3:
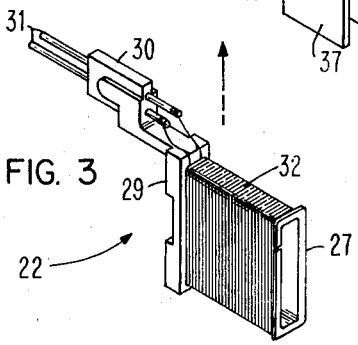
Figure 2:
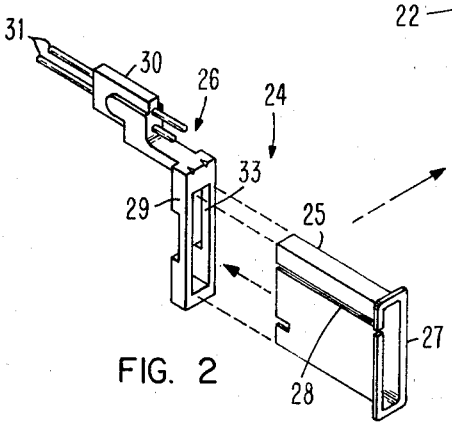

As seen in FIGS. 2–6, the operating winding assemblies are an individual unified structure preformed and assembled for quick easy mounting onto and removable from core leg 15. Each operating winding assembly 11 (FIG. 5) consists of a coil and bobbin assembly 22 (FIG. 3) and a magnetic shield/heat radiator structure 23 (FIG. 4). A bobbin assembly 24 (FIG. 2) for coil and bobbin assembly 22 consists of a non-magnetic metal bobbin 25 and a molded plastic pin holder 26. The metal bobbin 25 is thin walled (e.g. less than 0.007") with an outwardly flared flange 27 at one end. A slit 28 for preventing eddy currents is provided over the full length of bobbin 25 and flange 27. The thin-walled construction has several advantages. First, the cross-sectional area available for winding coil 32 on bobbin 25 is increased thereby increasing the amount of electromagnetic energy that can be produced in coil 32 without increasing the spacing between neighboring cores 10. Another advantage of the thin-walled construction is that the efficiency of the magnetic coupling achieved between the coil 32 and core leg 15 of magnetic core 10 and armature projection 13 of hammer element 12 is increased resulting also in a reduction in leakage flux. Also of great importance to the invention is the fact that the metal bobbin 25 acts as an excellent heat transfer medium for internally conducting heat generated from coils 32 to core 10 and eventually to base plate 21 which as a heat sink can dissipate the heat by conduction, radiation or convection as desired. To further enhance the heat transfer efficiency of bobbin 25, it is preferably structured in the form of a rectangular tube so as to closely conform to the rectangular cross-section of core leg 15 of magnetic core 10 so that the internal surfaces of bobbin 25 can be maintained in intimate thermal contact with the external surfaces of core leg 15 while at the same time permitting relatively easy assembly and separation of the operating winding assembly 11 and core leg 15.

In accordance with this invention bobbin 25 is also preferably treated with a thin layer of dielectric material to prevent the shorting of the coil 32. In the preferred embodiment, bobbin 25 is made of anodized aluminum with the dielectric material consists of aluminum oxide applied in any well known manner as a layer preferably having a thickness of 5 to 10 microns.

Pin holder 26 is preferably a single premolded part comprising a vertical rectangular frame portion 29 and a horizontal connector extension 30 formed with conductor pins 31 molded in position for connection to the ends of coil 32 (FIG. 3) after winding on bobbin 25 and for plugging into an external connector. A rectangular opening 33 in frame portion 29 receives the straight end of bobbin 25 for attachment thereto by flaring the end of bobbin 25 or by other suitable technique. When so attached, frame portion 29 of pin holder 26 becomes the second flange for retaining coil 32 on bobbin 25. Following attachment of pin holder 26 to bobbin 25, the bobbin assembly 24 may be placed on an arbor and coil 32 wound thereon with the desired number of turns and layers along bobbin 25 between frame portion 29 and flange 27. Following the winding of coil 32, the free ends thereof are connected to conductor pins 31. The coil and bobbin assembly 22 is now preferably impregnated with a high temperature epoxy system in the coil area only. Such an epoxy system might include Thermoset 314 made by Thermoset Plastic, Inc. The impregnation serves to prevent the wires of coil 32 from rubbing against each other during the print hammer operation and it also provides better heat transfer from coil 32 to bobbin 25.

As seen in FIG. 4, the magnetic shield and radiator assembly 23 comprises parallel plates 34 and 35 connected by folded strap 36. Plate 34 is essentially rectangular. Plate 35 is U-shaped with vertical extensions 37 and 38 and a horizontal extension 39. Vertical extensions 37 and 38 of plate 35 are separated in a parallel configuration to form a generally rectangular opening 40 having an area slightly larger than the area of one side of the operating winding portion of the coil and bobbin assembly 22. Opening 40 serves for locating coil and bobbin assembly 22 in proper position and alignment and for accommodating variations in tolerance of flange 27, frame position 29 and coil 32 without affecting the width of spacing between plates 34 and 35. For attachment to shield/radiator assembly 23 between plates 34 and 35, the coil and bobbin assembly 22 is preferably assembled to shield/radiator assembly 23 by injection molding of a mass of plastic material 43 which encapsulates the winding 32 and bonds the coil and bobbin assembly 32 to plates 34 and 35 and vice versa. For this purpose, holes 41 are formed in vertical extensions 37 and horizontal extension 39 to allow the injection molded mass of plastic material 43 to form a bond with frame 35. Similar holes 42 (see FIG. 6) are provided in plate 34 to assure attachment of coil and bobbin assembly 22 to shield radiator assembly 23. Also, as seen in FIG. 6, plastic material 43 forms a conductive heat transfer path from flange 27 to plates 34 and 35. In this manner, interior cooling is further provided to coil 32 particularly in the portion extending beyond end 14 of leg 15 of the magnetic core 10. A suitable plastic molding material usable for this purpose and having good heat conducting properties is Polyset EMC-90 made by Morton Corp.

Basically plates 34 and 35 and connecting strap 36 are made from a single piece of magnetic material such as silicon iron and then folded and held during molding of material 43 so that plate 34 and frame 35 are precisely parallel with their bottom and side edges substantially coextensive. Such a single piece construction is preferred for compactness as well as for improved shielding and heat transfer over other constructions. The space between plates 34 and 35 is made wide enough to accommodate coil and bobbin assembly 22 of FIG. 3 within opening 40 so that plate 34 makes good thermal contact with one side of winding 32 and plate 35 encloses and surrounds the ends of bobbin 24 so that the operating air gap is entirely surrounded between vertical extensions 37 and 38 and plate 34. This same air gap is also shielded by plate 34 of the neighboring coil. This assures that coil 32 is shielded from stray leakage flux in the vicinity of the air gap.

As seen most clearly in FIGS. 5 and 6, plastic material 43 when injection molded as a solid mass fills the spaces around coil 32 in opening 40 of plate 35 between coil 32 and plate 34 and between flange 27 of metal bobbin 25, plate 34 and vertical section 37 of plate 35 and into holes 42 and 41 thereof respectively. Thus plastic material 43 forms an integrated external and partially internal conductive heat transfer path between the winding portions of coil 32, bobbin 25 and magnetic shield plates 34 and 35. From FIG. 6 it can be readily seen that the operating winding assembly 11 is very compact and that good shielding of coil 32 from stray flux along with efficient external heat transfer from the sides of coil 32 is obtained in minimum space. With opening 40 provided in plate 35, coil 32 and metal bobbin 25 can be in part within the plane of coplanar extensions 37 and 38 of plate 35. This allows the operating winding assembly to be even more narrow so that in a multiple hammer configuration as shown in FIG. 1 can be more closely assembled and compact than with previous packaging designs. Furthermore the internal heat transfer provided by metallic bobbin to core leg 15 and magnetic plates 34 and 35 allows such compact multiple hammer assembly to be achieved for use in a high repetition, high speed print hammer environment.

Referring again to FIG. 1, the multiple hammer assembly shows that when the plural operating winding assemblies 11 are in place on core legs 15 of the several magnetic cores 10, the plates 34 face plates 35 of the adjacent shield/radiator assembly 23 thereby shielding their respective coils 32 and cores 10 from stray flux that may pass through opening 40 in plates 35. Thus a shield/radiator assembly 23 is provided which is fully interactive to shield against stray magnetic flux from adjacent coils 32. In addition, the arrangement of the operating winding assemblies 11 as shown in FIG. 1 provides a multiple finned radiator cooling system. Plates 34 and 35 along with straps 36 operate for diverting cooling air of a circulating air mass over each other and coils 32. Opening 44 in base plate 21 provides ingress or egress to such air flow.

Figure 7:
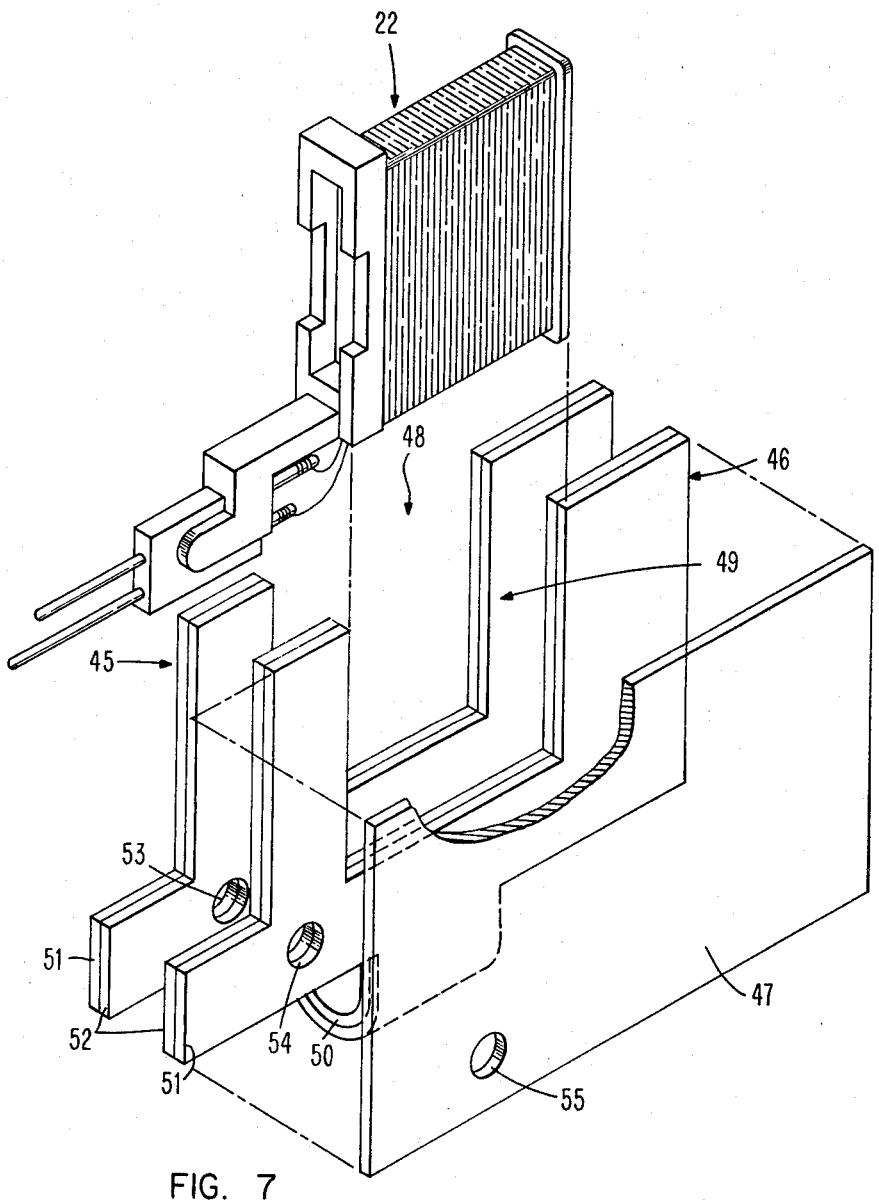
FIG. 7 is another embodiment of a coil assembly which incorporates the invention.

In a second embodiment as seen in FIG. 7, the magnetic shield/heat radiator assembly is provided to enhance the shielding properties as well as to provide good thermal conduction. As seen in FIG. 7, magnetic plates 45 and 46 are both essentially U-shaped with center openings 48 and 49 respectively. Plates 45 and 46 are connected by strap 50 in substantially the same manner of the embodiments of FIGS. 1–6. Plates 45 and 46 support coil and bobbin assembly 22 in alignment with openings 48 and 49 in substantially the same manner as in the first embodiment. In the embodiment of FIG. 7, a rectangular cover plate 47 of magnetic material such as silicon iron is attached to at least one of the U-shaped plates 45 or 46. Also in the embodiment of FIG. 7, plates 45 and 46 are preferably formed of laminated layers 51 and 52. In this structure the laminated layers 51 and 52 are made of magnetic material. Suitable materials for use in the structure of plates 45 and 46 can be a low carbon steel such as 1010 steel. The cover plate and the laminated plates 45 and 46 can be welded or bonded together to form the laminated structure. Holes 53, 54 and 55 in magnetic plates 45, 46 and 47 respectively are provided for receiving the plastic material to bond the magnetic shield structure to the coil and bobbin assembly 22 in the same manner as previously described.

The advantage of using laminated structures in the magnetic shields is that a more efficient shielding from stray flux is provided. Thus layers 51 and 52 serve as additional shunting paths for fringing flux of high intensity which may pass through the shielding 47 to adjacent coils 32. Such an arrangement, shown in FIG. 7 is useful where the spacing between hammers in a multiple hammer print assembly such as shown in FIG. 1 is not so critical, or where magnetic shielding is highly critical. Where high density spacing and lower cost is required, the embodiment of FIG. 1–6 is preferred.

While the present invention has been described in the context of preferred embodiments thereof, it will be readily apparent to those skilled in the art, that modifications and variations can be made therein without departing from the spirit and scope of the present invention. Accordingly, it is not intended that the present invention necessarily be limited to the specifics of the foregoing description of the preferred embodiments, but rather as being limited only by the claims appended hereto.

We claim:

1. A print hammer comprising a hammer element having a magnetic armature, a magnetic core forming a magnetic circuit with said armature including a leg forming an operating air gap with said magnetic armature, an operating winding assembly including an electrical energizable coil on said leg extending beyond the end of said leg and enclosing said operating air gap, and a heat exchange system for said coil comprising a heat sink member in a conductive heat transfer relationship with said magnetic core and the surrounding air mass, internal heat conductive means thermally coupled in a conductive heat transfer relationship with the inner surface of said coil and said leg of said core, external heat conductive means comprising a moldable mass of heat conductive material enclosing said coil, a magnetic shield structure comprising parallel magnetic plates, said magnetic plates having attachment openings occupied by said moldable mass for bonding said magnetic plates to said coil so as to be thermally coupled in a conductive heat transfer relationship with the exterior surface of said coil, said magnetic plates having portions extending beyond said winding and forming a shield against stray magnetic field flux in the vicinity of said operating winding, said portions of said magnetic plates forming a radiating fin structure for radiating heat to a surrounding air mass.

2. A print hammer in accordance with claim 1 in which said heat sink member comprises a metal block supporting said magnetic core, said hammer element and said operating winding assembly said internal heat conductive means comprises a non-magnetic metal bobbin, and said coil is a multi-turn coil wound the full length of said metal bobbin, said bobbin and said coil forming a coil assembly with said bobbin in a conductive heat transfer relationship with the surface of said leg of said core, said bobbin and said coil extending beyond the end of said leg so as to surround said operating air gap.

3. A print hammer in accordance with claim 2 in which said metal bobbin includes an integral flange portion at one end of said coil, and said moldable mass further forms a conductive heat transfer path with said flange portion of said bobbin and said magnetic plates.

4. A print hammer in accordance with claim 3 in which said integral flange of said metal bobbin is at the end of said coil which extends beyond said end of said leg of said magnetic core, and said conductive heat transfer path of said moldable mass with said flange is with the interior surface of said coil and said magnetic plates.

5. A print hammer in accordance with claim 2 in which said metal bobbin is aluminum, said magnetic plates are silicon iron, and said moldable heat conductive material is an epoxy.

6. A print hammer in accordance with claim 1 in which at least one of said magnetic plates has an enlarged window opening of a size sufficient to receive said coil and a portion of said moldable mass for bonding said one of said magnetic plates to said coil around said enlarged opening.

7. A print hammer in accordance with claim 1 in which said parallel magnetic plates of said magnetic shield structure are formed from a single sheet of magnetic material, said parallel magnetic plates being joined by a connecting integral strap bent in a loop, said loop coacting with said radiating fin structure for directing a cooling air mass over said operating winding assembly.

8. A print hammer in accordance with claim 7 in which said magnetic plates and said connecting strap are formed from a single sheet of silicon iron.

9. A print hammer in accordance with claim 1 in which said parallel magnetic shield plates of said magnetic structure are U-shaped frame members having central openings for receiving said coil assembly within said central openings, said coil assembly being attached to said U-shaped frame members said openings by said moldable material, said magnetic shield structure including a rectangular magnetic cooling plate attached to at least one of said frame members so as to cover said central opening and be in a heat conductive transfer relationship with the exterior of said coil assembly.

10. A print hammer in accordance with claim 9 in which said U-shaped frame members and said cover plate have different permeabilities and saturation levels.

11. A print hammer in accordance with claim 10 in which said cover plate is silicon iron, and said frame members are low carbon steel.

12. A hammer in accordance with claim 10 in which said frame members have multiple laminated layers, said laminated layers and said cover plate having different permeabilities and saturation levels.

13. A print hammer in accordance with claim 12 in which said laminated layers are low carbon steel, and said cover plate is silicon iron.

14. A print hammer in accordance with claim 13 in which said laminated layers of low carbon steel is the interior layer.

15. A print hammer comprising a hammer element having a magnetic armature, a magnetic core forming a magnetic circuit with said armature including a leg forming an operating air gap with said magnetic armature, an operating winding assembly including an electrical energizable coil on said leg extending beyond the end of said leg and enclosing said operating air gap, and a heat exchange system for said coil comprising a heat sink member in a conductive heat transfer relationship with said magnetic core and the surrounding air mass, internal heat conductive means thermally coupled in a conductive heat transfer relationship with the inner surface of said coil and said leg of said core, and external heat conductive means comprising a magnetic shield structure thermally coupled in a conductive heat transfer relation with the exterior surface of said coil and a surrounding air mass, said magnetic shield structure comprising magnetic plates having multiple laminated layers of magnetic material, said multiple layers having different magnetic permeabilities and saturation levels, said magnetic shield structure providing a magnetic circuit return path for stray flux generated in the vicinity of said coil.

16. A print hammer in accordance with claim 15 in which said multiple laminated layers of said magnetic plates are formed of a silicon iron layer and low carbon steel layers.

17. A print hammer in accordance with claim 16 in which said silicon iron layer of said laminated layers is an inner layer attached to the outer surface of said coil.

* * * * *